US008408694B2

(12) United States Patent
Leykamm et al.

(10) Patent No.: US 8,408,694 B2
(45) Date of Patent: Apr. 2, 2013

(54) APPARATUS FOR LABELING CONTAINERS, COMPRISING A PRINTER UNIT

(75) Inventors: Dieter Leykamm, Neutraubling (DE); Christoph Klenk, Wenzenbach (DE)

(73) Assignee: Krones AG (DE)

( * ) Notice: Subject to any disclaimer, the term of this patent is extended or adjusted under 35 U.S.C. 154(b) by 170 days.

(21) Appl. No.: 12/993,073

(22) PCT Filed: Apr. 30, 2009

(86) PCT No.: PCT/EP2009/055267

§ 371 (c)(1), (2), (4) Date: Jan. 7, 2011

(87) PCT Pub. No.: WO2009/138327

PCT Pub. Date: Nov. 19, 2009

(65) Prior Publication Data

US 2011/0115843 A1 May 19, 2011

(30) Foreign Application Priority Data

May 16, 2008 (DE) ..... 10 2008 023 939

(51) Int. Cl.
*B41J 2/01* (2006.01)

(52) U.S. Cl. ..... 347/104; 347/2; 347/4

(58) Field of Classification Search ..... 347/2, 4, 347/16, 101, 104–107
See application file for complete search history.

(56) References Cited

U.S. PATENT DOCUMENTS

| | | | | |
|---|---|---|---|---|
| 5,827,389 | A * | 10/1998 | Takizawa et al. | 156/234 |
| 2002/0168212 | A1 | 11/2002 | Nedblake, Jr. et al. | 400/621 |
| 2007/0157576 | A1 | 7/2007 | Till | 53/471 |
| 2009/0145511 | A1 | 6/2009 | Till | 141/2 |
| 2010/0012252 | A1 | 1/2010 | Till | 156/64 |
| 2010/0059596 | A1 | 3/2010 | Achhammer | 235/492 |

FOREIGN PATENT DOCUMENTS

| | | |
|---|---|---|
| CN | 2346697 | 11/1999 |
| DE | 102005041221 | 3/2007 |
| DE | 102006001223 | 7/2007 |
| DE | 102006038249 | 2/2008 |
| EP | 1806291 | 7/2007 |
| GB | 2259888 | 3/1993 |
| GB | 2435242 | 8/2007 |
| JP | 2000-203547 | 7/2000 |
| WO | 03/086873 | 10/2003 |
| WO | 2005/084294 | 9/2005 |

OTHER PUBLICATIONS

Chinese Official Action and translation dated Apr. 19, 2012 (11 pgs).
International Search Report issued in Applicants' underlying PCT Application Serial No. PCT/EP09/055267 dated Aug. 18, 2009, 3 pgs.
Translation of Chinese Office Action, received Mar. 15, 2012 (4 pgs).

* cited by examiner

*Primary Examiner* — Juanita D Jackson
(74) *Attorney, Agent, or Firm* — Hayes Soloway P.C.

(57) ABSTRACT

An apparatus for labelling containers, includes a storage unit, in which a supply of labelling material is accommodated, a labelling device which is disposed in the transport direction (T) of the labels and attaches the labelling material onto the containers, and a print device, which provides the labelling material with an imprint. The print device is disposed in the transport direction (T) of the labelling material between the storage unit and the labelling device and is positioned in the transport direction (T) of the labelling material at a distance from the labelling device.

22 Claims, 1 Drawing Sheet

APPARATUS FOR LABELING CONTAINERS, COMPRISING A PRINTER UNIT

BACKGROUND OF THE INVENTION

The present invention relates to an apparatus for the labelling of containers. Apparatus of this type have long been known from the prior art. In this case, labels are attached for example in the form of self-adhering labels or even with the aid of an adhesive to an external periphery of the containers. It is customary from the prior art for these labels to be unrolled in an already printed form from a roll of labels and to be attached already printed to the container. In recent times, however, there has been an increasing tendency first to attach the labels unprinted to the containers and only then to print on the container. In this way, WO 99/08935 describes a method of attaching substances to a container In this case different substances are attached in succession to the containers.

DE 10 2006 001 223 A1 describes an apparatus for printing bottles or similar containers. In this case a print head is used which uses an electrostatic print head with a plurality of individual nozzles capable of being actuated individually for the controlled discharge of printing ink A method of labelling containers on the periphery is likewise known from DE 10 2006 038 249 A1. In this case an endless band of labels is first printed and is then wound deflected as a respective label around the container.

DE 10 2005 041 221 A1 describes a method of producing labels with RFID transponders. In this case at least part of the RFID transponder is formed during the production of the label.

A method of labelling bottles and similar containers as well an apparatus for performing this method is known from EP 1 806 291 A1. In this case the printing of labels is carried out by printing on a label starting material in a labelling station by a printing unit arranged there, before the labels are attached to the containers. This technique is likewise already known from WO 99/08935 named above.

In this way, in the prior art the labels are printed either only after they have been attached to the containers, or on the other hand immediately before being attached to the containers. In the prior art, therefore, printing systems, such as in particular digital printing systems, are frequently integrated directly in the labelling unit or in the machine. A drawback of this procedure is that, in the case where a digital printing system is used on a labelling unit or on a labelling machine, when the rolls of a unit are changed the latter has to have its speed reduced in order to achieve a secure adhesion of the start of a new roll of labels to the start of an old roll of labels. This leads to a considerable loss of efficiency of the plant, which also depends upon the performance of the plant. In addition, the printing systems arranged in the labelling units are accessible only with difficulty and assembly procedures are therefore difficult to carry out. This has been highly problematic until now, particularly in the case of the printing devices.

The object of the present invention is therefore to make available an apparatus for the labelling of containers with a higher degree of efficiency. In addition, the outlay on assembly and repair should also be reduced.

SUMMARY OF THE INVENTION

An apparatus according to the invention for the labelling of containers has a storage unit in which a store of label material is received. In addition, a labelling device arranged downstream of the storage unit in the conveying direction of the label material is provided, which attaches the label material to the containers. In addition, a printing device is provided which provides the label material with an imprint.

According to the invention the printing device is arranged between the labelling device and the storage unit in the conveying direction of the label material and is arranged at a distance from the labelling device in the conveying direction of the label material. In particular, the printing device is separated structurally from the labelling device.

A store of label material is to be understood in particular, but not exclusively, as being rolls of labels from which the label material is capable of being unwound. The printing device can be a printing device which essentially applies any imprints to the label material, for example multi-coloured prints or even date imprints. The spacing of the printing unit from the labelling device is to be understood, in particular, as being that the printing unit is arranged not on or in the labelling device itself, but preferably independently of the latter and upstream in the conveying direction of the label material In this way it is made possible for the printing device to be more easily accessible for assembly purposes.

The invention is based on the surprising knowledge that the printing device need not necessarily be a component part of the labelling device or need not be arranged directly on the labelling device.

In this way the printing procedure is no longer linked directly to the labelling procedure and so the efficiency of the apparatus can be increased. Direct printing of labels is thus preferably carried out with a store of rolls of labels, also referred to as a multi-reel, and in particular by means of an ink-jet digital printing system with an integrated ink management for in-line printing of self-adhesive labels.

This digital printing system makes it possible for different images and also any desired images to be printed on the label material depending upon requirements. In this way it is possible for the label material to be arranged in different graphic illustrations whilst retaining a specific basic form of the label material.

It is preferable for the apparatus to have a buffering device for the label material, in which buffering device a variable length of the label material is capable of being received, this buffering device being arranged between the storage unit and the labelling device in the conveying direction of the label material. On account of this buffering device, which is also referred to as a strip accumulator, it is possible for the storage unit and the labelling device to be de-coupled at least temporarily with respect to their operating speed, in which case the differences in speed which then occur are absorbed by way of this strip accumulator. In this way, when changing a strip for example, the labelling device can continue to be operated at an undiminished speed.

It is preferable for the printing device to be arranged upstream with respect to the buffering device in the conveying direction of the label material. In this way it is proposed in a particularly preferred manner that the printing device should be arranged for example in the form of the digital printing system close to and preferably directly on the storage unit.

It is preferable for the printing device to have an ink-jet printing element. This ink-jet printing element can have for example a plurality of individual nozzles which each comprise an opening and a needle-shaped electrode which is associated with this opening and which is arranged coaxially with the axis of the respective opening and, in a particularly preferred manner, terminates inside the nozzle at a distance from this opening. In this case it is preferable for a plurality of print heads to be provided, each of these print heads being designed in such a way that, particularly during the printing procedure, a printing ink contained in a housing interior is present with a pre-set hydrostatic pressure against the openings of the individual nozzles. In this case it is preferable for the afore-mentioned electrodes to be capable of being actuated independently of one another by way of a control device.

In the case of a further advantageous embodiment the apparatus is designed in such a way that a printing plane of the label material is situated in a horizontal plane between the storage unit and the buffering device. It is thus possible for an imprint to be made on this label material at a right angle to this horizontal plane and thus in a vertical direction. Effects of gravity, which can arise for example in the case of printing occurring obliquely, are minimized in this way, since gravity has a neutral effect with respect to the direction of printing. It is preferable for the printing device to be arranged above the label material, i.e. the label material is printed from above. In this way, ink-jet printing elements of the printing device are arranged in such a way that the printing medium, such as the ink, reach the label material in a vertical direction starting from the printing element.

It is preferable for the storage unit to have two receiving units for the label material. This is to be understood as meaning that the storage unit has at least two roll carriers on which rolls of labels can be arranged. As soon as one of these rolls of labels has run empty, the end thereof can be joined to the start of the second roll and the operation can be continued substantially with the speed undiminished. It would also be possible, however, for the storage unit to have a plurality of receiving units, for example 5, 8 or 10 receiving units, for the label material. The label material can be an endless band or an endless strip, which can then be printed individually and can likewise be attached individually to the containers.

It is preferable for the labelling device to have at least one separating device which separates self-adhesive, labels from a carrier material. The apparatus according to the invention is also, however, suitable for labels which are attached to the containers with the aid of an additionally applied adhesive.

In the case of a further advantageous embodiment the printing device and the storage unit are synchronized with each other. This means that in the event of slower operation of the storage unit or the exit speed of the label material the printing speed of the label material is also reduced.

In the case of a further advantageous embodiment the apparatus has a cutting device which cuts the label material at pre-set positions and thus has the effect that the individual cut labels are attached to the containers.

The present invention further relates to a method of attaching labels to containers, in which the label material is removed from a storage unit in which a store of label material is present, or this storage unit dispenses the label material respectively, this label material is supplied to a labelling device and the label material is attached to the containers. In this case a printing device is provided which provides the label material with at least one imprint. According to the in vention the printing device provides the label material with the imprint before the label material reaches the labelling device. In this way, it is also proposed in the case of the method according to the invention that the printing device should be arranged upstream of the labelling device and should preferably be de-coupled therefrom.

It is preferable for the label material to run through a buffering device, in which case the length of the label material is variable inside the buffering device. As mentioned above, this buffering device is used to compensate differences in speed arising during the operation between the storage unit and the labelling device.

It is preferable for the printing device to provide the label material with the imprint, before this label material reaches the buffering device.

It is preferable for the label material to be printed by the printing device in a vertical direction, i.e., as mentioned above it preferably extends in a horizontal plane.

In the case of a further preferred method the label material is printed with a date by the printing device. This date can reproduce for example a best-before date of the beverage in question.

In the case of a further advantageous embodiment the label material is provided with a colour print, and in particular a multi-colour print, by the printing device.

BRIEF DESCRIPTION OF THE DRAWINGS

Further advantages and embodiments may be seen in the accompanying drawings. In the drawings.

DETAILED DESCRIPTION OF THE INVENTION

Figure 1:
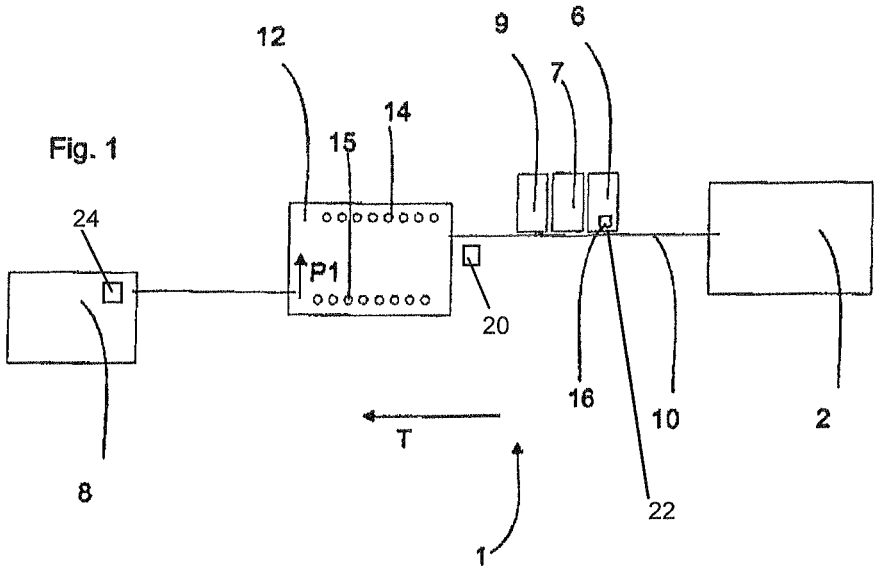
FIG. 1 is a diagrammatic illustration of an apparatus according to the invention for the labelling of containers.

FIG. 1 is a highly diagrammatic illustration of an apparatus 1 according to the invention for the labelling of containers 20. This apparatus 1 has a storage unit 2 for label material 10, in which storage unit 2 for example a plurality of rolls of labels are arranged, from which the label material 10 can be unwound.

Subsequently to this storage unit 2 the label material arrives towards the left in the conveying direction T and is conveyed past a printing device 6. In this case this printing device 6 has printing elements, such as for example ink-jet printing elements 16, which preferably are arranged in such a way that the printing medium 22 is directed onto the label material 10 in a vertical direction starting from the printing element 16. Subsequently to this printing element a drying device 7 is provided which dries the label material or the prints applied thereto respectively. In this case this drying can be carried out for example with UV light. In addition, an inspection device 9 can be provided which checks to see whether the imprints have been applied correctly to the label material 10. In addition, it is also possible for a printing device 6 or even a further printing device to attach markings—which can be used in a subsequent cutting procedure of the label material 10—to the label material 10. It would also be possible, however, for specified areas of a print image and, in particular, distinctive areas of the print image to be used as markings for the cutting procedure.

A printing device 6 has a buffering device 12 attached to it in the conveying direction T. This buffering device 12 has a plurality of upper reversing shafts 14 and lower reversing shafts 15 around which the label material (not shown) is guided. The length of the label material inside the buffering device 12 can be varied by displacement of the complete set of the upper and/or lower reversing shafts (arrow P1).

The buffering device 12 has a labelling device 8 attached to it, which attaches the label material to the containers. In this case a cutting device can additionally be provided, which cuts the label material 10 to form strips of labels in the appropriate length, so that these can then be attached to the containers. In this case it is possible to use both self-adhesive labels which are arranged on a carrier as the label material, and a band of labels which is subsequently provided with adhesive and attached to the containers.

It is preferable for a recognition device, which recognizes a marking applied to the label material and thus initiates the cutting procedure correctly, to be provided in the region of the labelling device 8.

Figure 2:
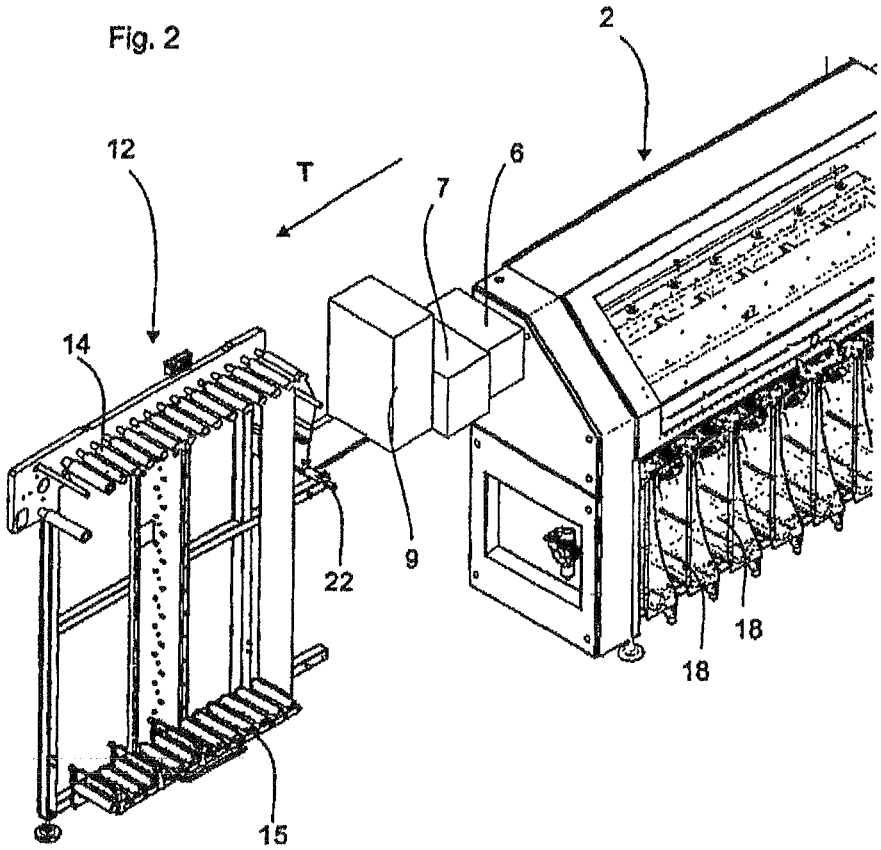
FIG. 2 is a detailed illustration of the apparatus as shown in FIG. 1.

FIG. 2 is a detailed illustration of an apparatus according to the invention. In this case it is evident that a storage unit 2 has a plurality of receiving devices 18 for rolls of labels. In addition, joining units can also be provided, which join ends of rolls of labels to the starts of further rolls of labels. The printing device 6, the drying device 7 and the inspection device 9 are arranged directly on the storage unit 2 and thus print (and dry and inspect respectively) the label material 10 immediately after it leaves the storage unit 2. As a result of this arrangement of the printing device 6 directly on the storage unit 2 a particularly advantageous accessibility of the printing device 6 is achieved on the one hand, and the label material is also transferred in a particularly precise manner to the printing device on the other hand.

It would even be possible for the printing devices 6 still to be arranged inside the storage unit 2. After the printing devices 6 the label material arrives in the buffering device 12 by way of a reversing roll 22, this being shown, however, only in part. In this case the label material 10 is preferably conveyed to the respective upper reversing roll 14 of the buffering device 12 in such a way that the printed side of the label material 10 is not in contact with the reversing rolls 14.

Subsequently to the buffering device the label material arrives at a labelling device 8 which may include, for example, at least one separating device 24 which separates self-adhesive labels from their carries material, as mentioned above.

All the features disclosed in the application documents are claimed as being essential to the invention, insofar as they are novel either individually or in combination as compared with the prior art.

The invention claimed is:

1. An apparatus for the labelling of containers, said apparatus comprising a storage unit, in which a store of label material is received, a labelling device arranged downstream of the storage unit in a conveying direction (T) of the label material for attaching the label material to the containers, and a printing device for providing the label material with an imprint, wherein the printing device is arranged between the storage unit and the labelling device in the conveying direction (T) of the label material and is arranged spaced from the labelling device in the conveying direction (T) of the label material.

2. The apparatus according to claim 1, wherein the apparatus further includes a buffering device for receiving variable lengths of the label material, wherein the buffering device is arranged between the storage unit and the labelling device in the conveying direction (T) of the label material.

3. The apparatus according to claim 2, wherein the printing device is provided upstream with respect to the buffering device in the conveying direction (T) of the label material.

4. The apparatus according the claim 2, wherein the buffering device has a plurality of upper reversing shafts and lower reversing shafts around which the label material is guided, and wherein a length of the label material inside the buffering device can be varied by displacement of the upper and/or lower reversing shafts.

5. The apparatus according to claim 2, wherein the buffering device is arranged after the printing device in the conveying direction (T) of the label material.

6. The apparatus according to claim 1, wherein the printing device comprises an ink-jet printer.

7. The apparatus according to claim 1, wherein a printing plane of the label material is situated in a horizontal plane between the storage unit and the buffering device.

8. The apparatus according to claim 7, wherein the printing device is arranged above the label material.

9. The apparatus according to claim 8, wherein the printing device comprises an ink-jet printer having ink-jet printing elements arranged to direct a printing medium onto the label material in a vertical direction starting from the printing element.

10. The apparatus according to claim 1, wherein the storage unit has at least two receiving units for the label material.

11. The apparatus according to claim 1, wherein the store of label material comprises self-adhesive labels on a carrier material, and the labelling device has at least one separating device which separates the self-adhesive labels from the carrier material.

12. The apparatus according to claim 1, wherein the printing device comprises a digital printing system arranged in the storage unit.

13. The apparatus according to claim 1, wherein the printing device and the storage unit are synchronized with each other.

14. A method of attaching labels to containers using the apparatus according to claim 1, wherein label material is removed from a storage unit containing a store of label material and supplied to a labelling device for attachment to the containers, wherein a printing device provides the label material with at least one imprint before the label material reaches the labelling device.

15. The method according to claim 14, wherein the label material is conveyed through a buffering device in which variable lengths of label material are accommodated.

16. The method according to claim 15, wherein the printing device provides the label material with an imprint, before said label material reaches the buffering device.

17. The method according to claim 14, wherein the label material is printed by the printing device in a vertical direction.

18. The method according to claim 14, wherein the label material is printed with a date by the printing device.

19. The method according to claim 14, wherein the label material is provided with a colour print by the printing device.

20. The method according to claim 14, wherein the label material is provided with a multi-colour print.

21. The method according to claim 14, including the step of de-coupling the storage unit and the labelling device temporarily with respect to their operating speed.

22. An apparatus for the labelling of containers, said apparatus comprising a storage unit in which a store of label material is received, a labelling device arranged downstream of the storage unit in a conveying direction (T) of the label material for attaching the label material to the containers, and a printing device for providing the label material with an imprint, wherein the printing device is arranged between the storage unit and the labelling device in the conveying direction (T) of the label material and at a distance from the labelling device in the conveying direction (T) of the label material, wherein the apparatus further includes a buffering device arranged between the storage unit and the labelling device in the conveying direction (T) of the label material, for receiving label material from the storage unit.

* * * * *